US012617579B2

(12) United States Patent
Weaver

(10) Patent No.: US 12,617,579 B2
(45) Date of Patent: May 5, 2026

(54) TRAY WITH SEPARABLE FEATURES

(71) Applicant: Graphic Packaging International, LLC, Atlanta, GA (US)

(72) Inventor: Sharon M. Weaver, Chicago, IL (US)

(73) Assignee: Graphic Packaging International, LLC, Atlanta, GA (US)

( * ) Notice: Subject to any disclaimer, the term of this patent is extended or adjusted under 35 U.S.C. 154(b) by 252 days.

(21) Appl. No.: 18/199,538

(22) Filed: May 19, 2023

(65) Prior Publication Data

US 2023/0373681 A1 Nov. 23, 2023

Related U.S. Application Data

(60) Provisional application No. 63/344,114, filed on May 20, 2022.

(51) Int. Cl.

| | |
|---|---|
| ***B65D 5/54*** | (2006.01) |
| ***B65D 5/20*** | (2006.01) |
| ***B65D 5/64*** | (2006.01) |

(52) U.S. Cl.

CPC ..... *B65D 5/5495* (2013.01); *B65D 5/2047* (2013.01); *B65D 5/64* (2013.01)

(58) Field of Classification Search

CPC ..... B65D 5/5495; B65D 5/2047; B65D 5/64; B65D 5/243; B65D 5/209; B65D 5/246; B65D 21/0206; B65D 75/24; B65D 75/225; B65D 71/403; B65D 71/0033; B65D 71/40; B65D 85/325

USPC ..... 206/558

See application file for complete search history.

(56) References Cited

U.S. PATENT DOCUMENTS

| | | | | |
|---|---|---|---|---|
| 2,085,827 A | | 7/1937 | Perreton | |
| 2,281,592 A | | 5/1942 | O'Brien | |
| 2,987,176 A | * | 6/1961 | Ringler | B65D 71/16 206/428 |
| 3,156,358 A | | 11/1964 | Randrup | |
| 3,747,835 A | | 7/1973 | Graser | |
| 3,765,595 A | | 10/1973 | Bernhardt | |
| 3,767,042 A | | 10/1973 | Ganz | |

(Continued)

FOREIGN PATENT DOCUMENTS

| | | |
|---|---|---|
| CN | 304728653 | 7/2018 |
| EP | 0 094 806 | 11/1983 |

(Continued)

OTHER PUBLICATIONS

International Search Report and Written Opinion for PCT/US2023/022855 dated Sep. 23, 2023.

(Continued)

*Primary Examiner* — Ernesto A Grano

(74) *Attorney, Agent, or Firm* — Andrew N. Claerbout; FisherBroyles, LLP

(57) ABSTRACT

A tray for holding one or more articles includes a plurality of tray portions, each tray portion having a plurality of panels extending at least partially around a respective tray compartment, and a plurality of end flaps foldably connected to a respective panel of the respective plurality of panels, the plurality of end flaps of each respective tray portion including a respective plurality of top end flaps arranged to form a respective flange separably connected to a respective flange of a respective adjacent tray portion of the plurality of tray portions.

39 Claims, 10 Drawing Sheets

(56) References Cited

U.S. PATENT DOCUMENTS

| | | | | |
|---|---|---|---|---|
| 3,780,906 | A | 12/1973 | Katzenmeyer | |
| 3,881,648 | A | 5/1975 | Hall | |
| 3,963,121 | A | 6/1976 | Kipp | |
| 3,964,607 | A | 6/1976 | Wagner | |
| 3,983,999 | A * | 10/1976 | Morton | B65D 21/0206 206/820 |
| D257,109 | S | 9/1980 | Conti | |
| 4,241,863 | A | 12/1980 | Faller | |
| 4,256,226 | A | 3/1981 | Stone | |
| 4,265,390 | A * | 5/1981 | Faller | B65D 5/28 229/169 |
| 4,304,329 | A | 12/1981 | Graser | |
| 4,424,901 | A | 1/1984 | Lanier | |
| 4,471,870 | A | 9/1984 | Uhlig | |
| 4,631,046 | A * | 12/1986 | Kennedy | B65D 5/4208 493/63 |
| 4,708,284 | A | 11/1987 | Sutherland et al. | |
| 4,875,585 | A | 10/1989 | Kadleck et al. | |
| 4,913,291 | A | 4/1990 | Schuster | |
| 4,925,019 | A | 5/1990 | Ganz et al. | |
| 5,042,660 | A | 8/1991 | Carver | |
| 5,123,527 | A | 6/1992 | Hustad | |
| 5,297,673 | A | 3/1994 | Sutherland | |
| 5,335,845 | A | 8/1994 | Liu | |
| 5,351,815 | A | 10/1994 | Fogle et al. | |
| 5,377,862 | A | 1/1995 | Oakes et al. | |
| 5,400,901 | A | 3/1995 | Harrelson | |
| 5,418,008 | A * | 5/1995 | Calvert | D21H 27/10 427/361 |
| 5,485,915 | A | 1/1996 | Harris | |
| 5,489,062 | A * | 2/1996 | Wagner | B65D 5/4208 229/117.18 |
| 5,549,197 | A | 8/1996 | Sutherland | |
| 5,590,776 | A | 1/1997 | Galbierz et al. | |
| 5,595,291 | A | 1/1997 | Negelen | |
| 5,609,251 | A | 3/1997 | Harris | |
| 5,813,540 | A | 9/1998 | Vollbrecht | |
| 5,845,776 | A | 12/1998 | Galbierz | |
| 5,853,088 | A | 12/1998 | Saulas et al. | |
| 5,941,389 | A | 8/1999 | Gomes | |
| 5,975,287 | A | 11/1999 | Negelen | |
| D417,785 | S | 12/1999 | Daniels | |
| 6,027,017 | A * | 2/2000 | Kuhn | B65D 5/5495 229/125.32 |
| 6,371,365 | B1 | 4/2002 | Doucette et al. | |
| 6,378,697 | B1 | 4/2002 | Sutherland et al. | |
| D466,758 | S | 12/2002 | Bradley | |
| 6,643,995 | B1 * | 11/2003 | Koyama | B65D 5/246 53/329.3 |
| 6,658,815 | B1 | 12/2003 | Gaspar | |
| 6,814,228 | B2 | 11/2004 | Sutherland | |
| 6,877,600 | B2 | 4/2005 | Sutherland | |
| 6,981,631 | B2 | 1/2006 | Fogle et al. | |
| 7,175,020 | B2 | 2/2007 | Sutherland et al. | |
| 7,225,930 | B2 | 6/2007 | Ford et al. | |
| 7,374,038 | B2 | 5/2008 | Smalley | |
| 7,793,779 | B2 | 9/2010 | Spivey, Sr. | |
| 7,832,621 | B2 | 11/2010 | Smalley | |
| 7,959,062 | B2 | 6/2011 | Auclair | |
| 8,387,784 | B2 | 3/2013 | Gonzalez | |
| 8,602,209 | B2 | 12/2013 | Jones et al. | |
| 8,622,207 | B2 | 1/2014 | Smalley | |
| 9,193,521 | B2 | 11/2015 | Wilhelm | |
| D756,560 | S | 5/2016 | Ghiotti | |
| 10,562,686 | B2 | 2/2020 | Spivey, Sr. et al. | |
| 10,858,145 | B2 | 12/2020 | Spivey, Sr. et al. | |
| 11,370,576 | B1 * | 6/2022 | Bevier | B65D 5/243 |
| D1,004,431 | S | 11/2023 | Kastanek | |
| 11,827,428 | B2 * | 11/2023 | Zwaga | B65D 5/0085 |
| 12,179,969 | B2 * | 12/2024 | Anghileri | B65D 77/003 |
| 2002/0112973 | A1 | 8/2002 | Sutherland | |
| 2002/0153408 | A1 * | 10/2002 | Stone | B65D 5/244 229/114 |
| 2005/0001020 | A1 | 1/2005 | Garnier | |
| 2006/0283744 | A1 | 12/2006 | Kruit | |
| 2008/0190785 | A1 | 8/2008 | Spivey | |
| 2008/0230406 | A1 | 9/2008 | Cuomo | |
| 2008/0257942 | A1 | 10/2008 | LeBras | |
| 2010/0078337 | A1 | 4/2010 | Sutherland | |
| 2010/0175351 | A1 | 7/2010 | Hand | |
| 2010/0264043 | A1 | 10/2010 | De Paula | |
| 2011/0016831 | A1 | 1/2011 | Huber | |
| 2011/0132978 | A1 | 6/2011 | De Sousa | |
| 2011/0226845 | A1 | 9/2011 | DePaula | |
| 2011/0284623 | A1 | 11/2011 | Jones et al. | |
| 2012/0067755 | A1 | 3/2012 | Spivey, Sr. | |
| 2013/0256392 | A1 | 10/2013 | Kohler | |
| 2013/0292285 | A1 | 11/2013 | Kastanek | |
| 2014/0021071 | A1 | 1/2014 | Alexander | |
| 2014/0021080 | A1 | 1/2014 | Fitzwater | |
| 2014/0027318 | A1 | 1/2014 | Sutherland | |
| 2014/0042215 | A1 | 2/2014 | Sutherland | |
| 2014/0174976 | A1 | 6/2014 | Ramberg et al. | |
| 2014/0353367 | A1 * | 12/2014 | Fairchild, Jr. | B65D 5/6608 229/149 |
| 2017/0240329 | A1 | 8/2017 | Spivey, Sr | |
| 2018/0319568 | A1 * | 11/2018 | Tye | B65D 77/286 |
| 2020/0068904 | A1 | 3/2020 | Smith | |
| 2022/0053900 | A1 | 2/2022 | Antonyan | |
| 2022/0144490 | A1 * | 5/2022 | Brink | B65D 85/34 |
| 2023/0182428 | A1 * | 6/2023 | Whatling | B65D 5/2047 229/169 |
| 2023/0348128 | A1 * | 11/2023 | Anghileri | B65D 77/003 |
| 2023/0373681 | A1 | 11/2023 | Weaver | |
| 2024/0190631 | A1 * | 6/2024 | Chesnet | B65D 71/42 |
| 2024/0217696 | A1 * | 7/2024 | Herrero Perez Rioja | B65D 5/48016 |
| 2024/0246717 | A1 * | 7/2024 | Zwaga | B65D 5/243 |
| 2024/0375368 | A1 * | 11/2024 | Syers | B65D 5/5495 |

FOREIGN PATENT DOCUMENTS

| | | |
|---|---|---|
| EP | 0 459 658 | 12/1991 |
| FR | 2 292 640 A1 | 6/1976 |
| FR | 2 412 473 | 7/1979 |
| JP | 08-119261 A | 5/1996 |
| JP | 2002-012222 A | 1/2002 |
| JP | D1756177 | 10/2024 |
| WO | WO 94/02380 | 2/1994 |

OTHER PUBLICATIONS

Organic Protein Snack Box at Whole Foods Market. Date first available: 2025. Site visited: Jan. 13, 2025. Available online: https://www.wholefoodsmarket.com/product/overt-organic-protein-snack-box-b088pf37cc (Year: 2025).

* cited by examiner

TRAY WITH SEPARABLE FEATURES

CROSS-REFERENCE TO RELATED APPLICATION

This application claims the benefit of U.S. Provisional Patent Application No. 63/344,114, filed on May 20, 2022.

INCORPORATION BY REFERENCE

The disclosures of each of U.S. Provisional Patent Application No. 63/344,114, filed on May 20, 2022, and U.S. Design patent application No. 29/892,605, filed on May 19, 2023, are hereby incorporated by reference for all purposes as if set forth in their entireties.

BACKGROUND OF THE DISCLOSURE

The present disclosure generally relates to containers for holding at least one article. In one embodiment, the present disclosure relates to containers in the form of trays for holding at least one article and that include separable features.

SUMMARY OF THE DISCLOSURE

According to one aspect, the disclosure is generally directed to a tray for holding one or more articles, the tray comprising a plurality of tray portions, each tray portion comprising a plurality of panels extending at least partially around a respective tray compartment, and a plurality of end flaps foldably connected to a respective panel of the respective plurality of panels, the plurality of end flaps of each respective tray portion comprising a respective plurality of top end flaps arranged to form a respective flange separably connected to a respective flange of a respective adjacent tray portion of the plurality of tray portions.

According to another aspect, the disclosure is generally directed to a system, the system comprising a lid and a tray supporting the lid. The tray comprises a plurality of tray portions, each tray portion comprising a plurality of panels extending at least partially around a respective tray compartment; and a plurality of end flaps foldably connected to a respective panel of the respective plurality of panels, the plurality of end flaps of each respective tray portion comprising a respective plurality of top end flaps arranged to form a respective flange separably connected to a respective flange of a respective adjacent tray portion of the plurality of tray portions.

According to another aspect, the disclosure is generally directed to a blank for forming a tray for holding one or more articles, the blank comprising a plurality of tray portions for forming a plurality of tray portions of the tray formed from the blank, each tray portion of the blank comprising a plurality of panels for extending at least partially around a respective tray compartment of the tray formed from the blank, and a plurality of end flaps foldably connected to a respective panel of the respective plurality of panels, the plurality of end flaps of each respective tray portion of the blank comprising a respective plurality of top end flaps for being arranged to form a respective flange separably connected to a respective flange of a respective adjacent tray portion of the plurality of tray portions of the tray formed from the blank.

According to another aspect, the disclosure is generally directed to a combination of blanks for forming a system, the combination comprising a tray blank for forming a tray for holding one or more articles, the tray blank comprising a plurality of tray portions for forming a plurality of tray portions of the tray formed from the tray blank, each tray portion of the tray blank comprising a plurality of panels for extending at least partially around a respective tray compartment of the tray formed from the tray blank, and a plurality of end flaps foldably connected to a respective panel of the respective plurality of panels, the plurality of end flaps of each respective tray portion of the tray blank comprising a respective plurality of top end flaps for being arranged to form a respective flange separably connected to a respective flange of a respective adjacent tray portion of the plurality of tray portions of the tray formed from the tray blank. The combination further comprises a lid blank for forming a lid for being at least partially supported by the tray formed from the tray blank.

According to another aspect, the disclosure is generally directed to a method of forming a tray for holding one or more articles, the method comprising obtaining a blank comprising a plurality of tray portions, each tray portion comprising a plurality of panels and a plurality of end flaps foldably connected to a respective panel of the respective plurality of panels, the plurality of end flaps of each respective tray portion comprising a respective plurality of top end flaps. The method further comprises positioning each plurality of panels extending around a respective tray compartment of a respective plurality of tray portions of the tray, and arranging the plurality of end flaps of each respective tray portion of the blank to form a respective flange separably connected to a respective flange of a respective adjacent tray portion of the plurality of tray portions of the tray.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Containers according to the present disclosure can accommodate containers of numerous different shapes. In this specification, the terms "lower," "bottom," "upper," "top," "front," and "back" indicate orientations determined in relation to fully erected containers. As described herein, containers may be formed by multiple overlapping panels, portions, and/or end flaps. Such panels, portions, and/or end flaps may be designated in relative terms to one another, e.g., "first", "second", "third", etc., in sequential or non-sequential reference, without departing from the disclosure.

Figure 1:
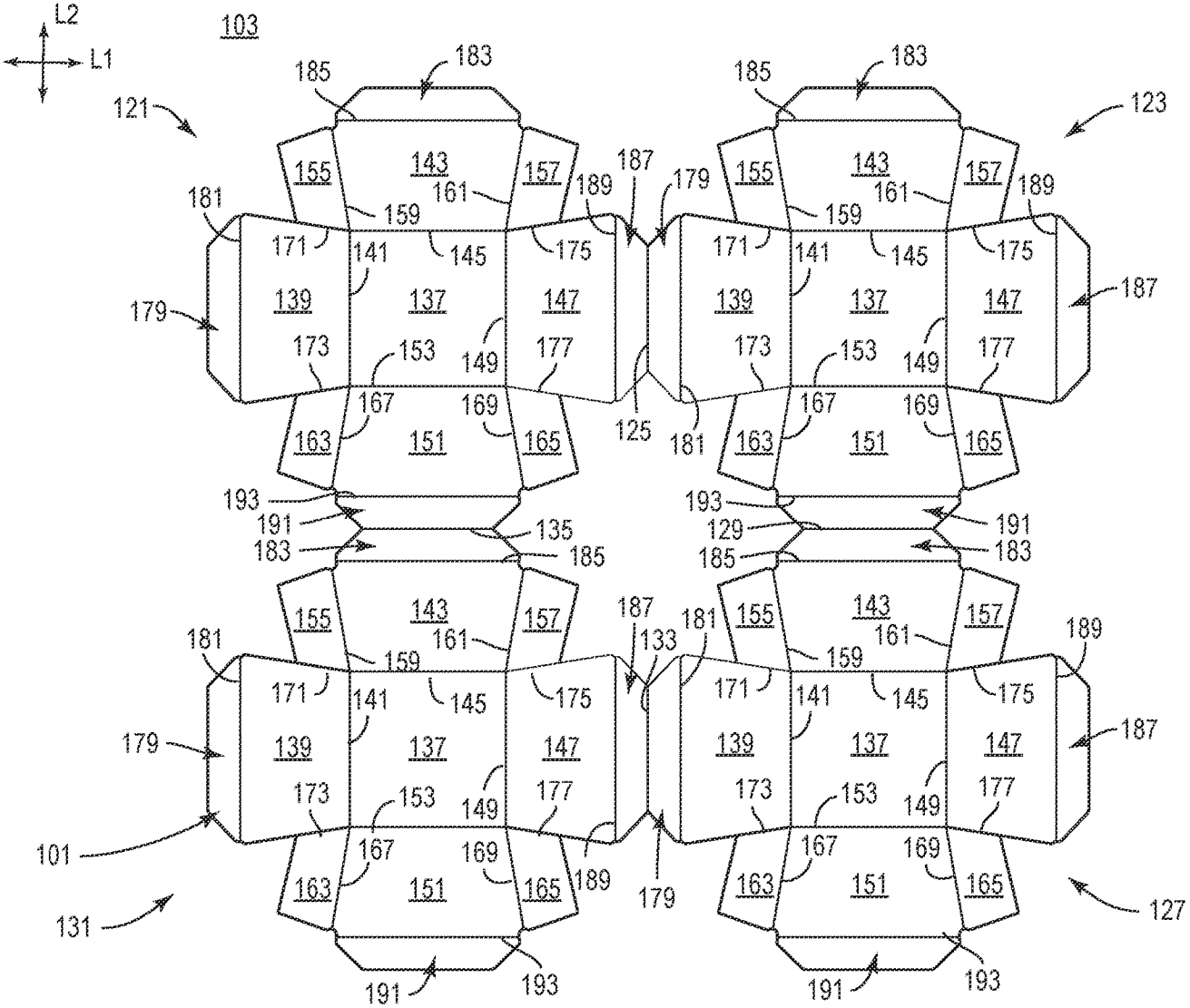
FIG. 1 is a plan view of an exterior surface of a tray blank for forming a tray according to a first exemplary embodiment of the disclosure.
Figure 2:
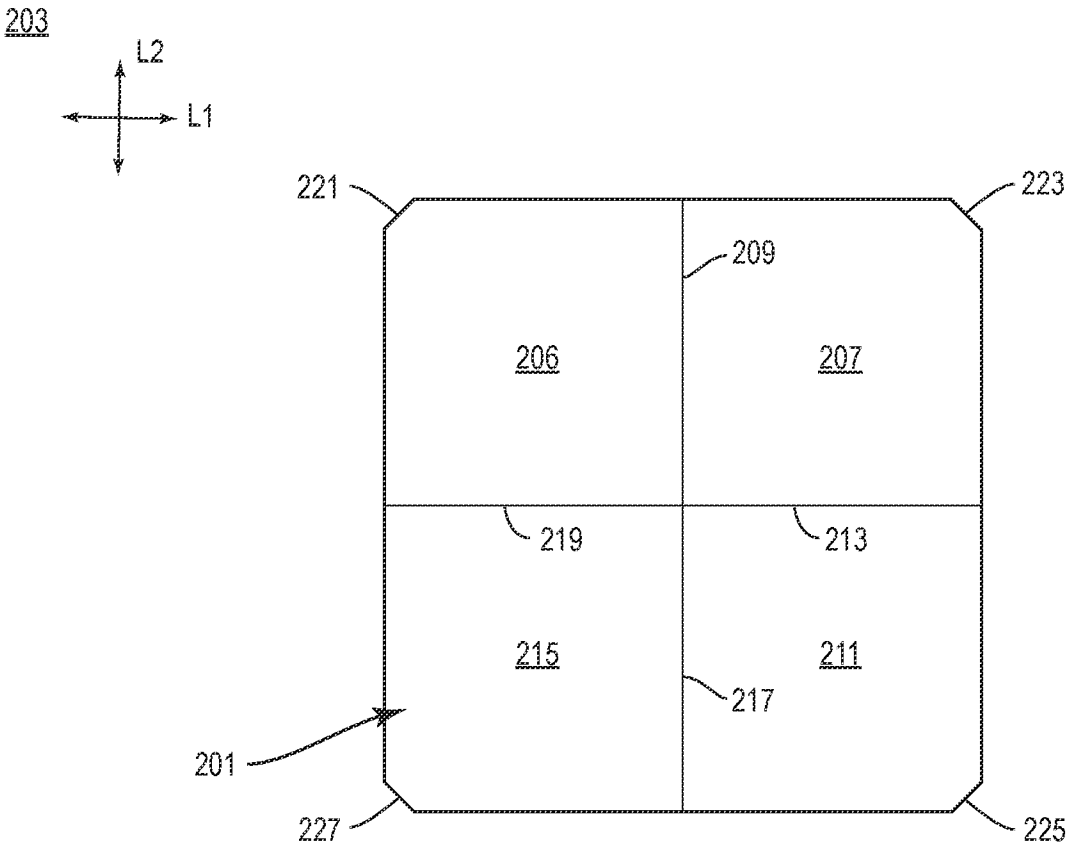
FIG. 2 is a plan view of an exterior surface of a lid blank for forming a lid according to the first exemplary embodiment of the disclosure.
Figure 3:
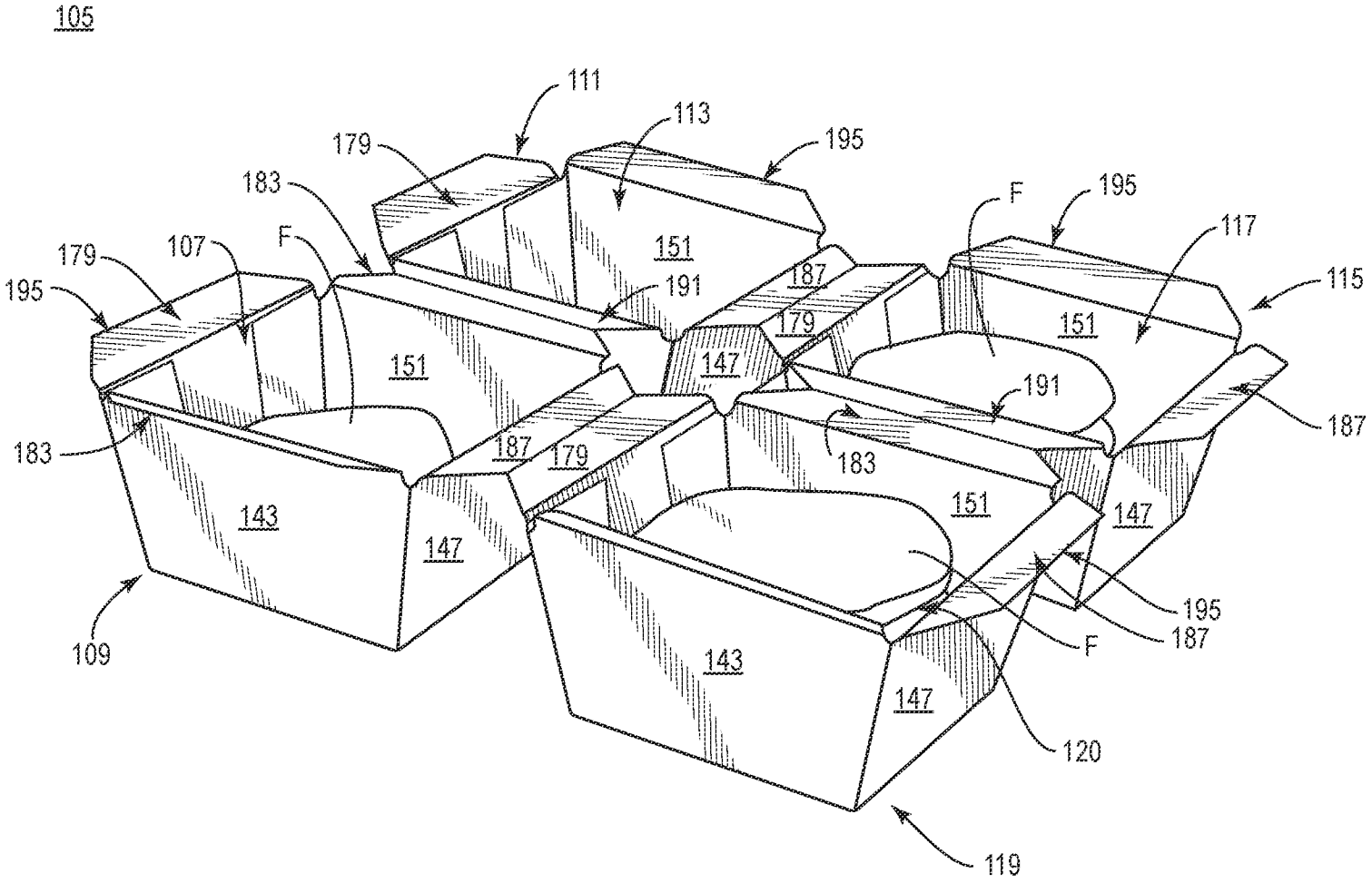
FIG. 3 is a perspective view of a tray formed from the blank of FIG. 1 according to the first exemplary embodiment of the disclosure.

According to a first exemplary embodiment of the disclosure, FIG. 1 illustrates an exterior surface 101 of a tray blank 103 for forming a container in the form of a tray 105 (FIG. 3). It will be understood that the tray 105 can have a different configuration, for example, a bowl, dish, plate, box, or carton, to name a few. In some embodiments, a lid blank 203 (FIG. 2) can be provided in combination with the tray blank 103 for forming a lid 205 (FIG. 4) therefrom for use with the tray 105 formed from the tray blank 103.

As described herein, the tray 105 can be used for holding one or more articles such as food products, e.g., portioned retail food products that can include one or more of cookies, crackers, cakes, pastries, candies, nuts, popcorn, trail mix, gum, etc. In some embodiments, the articles can include frozen or non-frozen food products that can be provided in discrete portions, for example, chicken nuggets, French fries, onion rings, mozzarella sticks, chips, popcorn, other finger foods, etc. In some embodiments, other types of articles that can include food products and/or non-food products can be placed in the tray 105 for service to a customer. In some embodiments, such products can be contained in additional packaging and then placed in the tray 105. The tray 105 could be otherwise shaped and arranged and could be used to hold other products and/or articles in similar or different environments without departing from the disclosure.

As shown in FIG. 1, the blank 103 has a lateral axis L1 and a longitudinal axis L2. The blank 103 can include a plurality of tray portions for forming a plurality of tray portions of the tray 105. As described further herein, the tray portions of the blank are separable from one another and are for forming respective tray portions of the tray 105 that are separable from one another.

In the illustrated embodiment, the blank 103 can include a first tray portion 121 separably connected to a second tray portion 123 at a lateral tear line 125. The blank 103 can also include a third tray portion 127 separably connected to the second tray portion 123 at a longitudinal tear line 129, and a fourth tray portion 131 separably connected to the third tray portion 127 at a lateral tear line 133. The fourth tray portion 131 can also be separably connected to the first tray portion 121 at a longitudinal tear line 135.

Each tray portion 121, 123, 127, 131 can have respective plurality of panels including a bottom panel 137, a first side panel 139 foldably connected to the bottom panel 137 at a lateral fold line 141, a second side panel 143 foldably connected to the bottom panel 137 at a longitudinal fold line 145, a third side panel 147 foldably connected to the bottom panel 137 at a lateral fold line 149, and a fourth side panel 151 foldably connected to the bottom panel 137 at a longitudinal fold line 153.

A respective plurality of end flaps can be foldably connected to a respective panel of the respective plurality of panels, and can include a pair of side end flaps 155, 157 foldably connected to the side panel 143 at respective oblique fold lines 159, 161, and a pair of side end flaps 163, 165 foldably connected to the side panel 151 at a respective oblique fold lines 167, 169. The side end flaps 155, 163 can be at least partially separated/separable from the side panel 139 at a respective oblique cuts 171, 173, and the side end flaps 157, 165 can be at least partially separated/separable from the side panel 147 at respective oblique cuts 175, 177.

Each respective plurality of end flaps can also include a first top end flap 179 foldably connected to the side panel 139 at a lateral fold line 181, a second top end flap foldably connected to the side panel 143 at a longitudinal fold line 185, a third top end flap 187 foldably connected to the side panel 147 at a lateral fold line 189, and a fourth top end flap 191 foldably connected to the side panel 151 at a longitudinal fold line 193.

In the illustrated arrangement, the top end flap 187 of the first tray portion 121 of the blank 103 is separable from the top end flap 179 of the second tray portion 123 of the blank 103 at the tear line 125, the top end flap 191 of the second tray portion 123 of the blank 103 is separable from the top end flap 183 of the third tray portion 127 of the blank 103 at the tear line 129, the top end flap 179 of the third tray portion 127 of the blank 103 is separable from the top end flap 187 of the fourth tray portion 131 of the blank 103 at the tear line 133, and the top end flap 183 of the fourth tray portion 131 of the blank 103 is separable from the top end flap 191 of the first tray portion 121 of the blank 103 at the tear line 135.

It will be understood that one or more portions of the blank 103 can have a different arrangement and/or configuration without departing from the disclosure. In some embodiments, the tray portions 121, 123, 127, 131 of the blank 103 can have a generally similar configuration, as shown in the illustrated embodiment. In some embodiments, one or more of the tray portions 121, 123, 127, 131 of the blank 103 can have a different configuration without departing from the disclosure.

Turning to FIG. 2, an exterior surface 201 of the lid blank 203 is illustrated. The lid blank 203 can include a plurality of lid panels including a first lid panel 206 separably connected to a second lid panel 207 at a lateral tear line 209, a third lid panel 211 separably connected to the lid panel 207 at a lateral tear line 213, and a fourth lid panel 215 separably connected to the lid panel 211 at a lateral tear line 217 and separably connected to the lid panel 206 at a longitudinal tear line 219.

In the illustrated arrangement, endpoints of the respective tear lines 209, 213, 217, 219 generally intersect at the center of the lid blank 203. In some embodiments, the tear lines 209, 217 can be segments of a single tear line. In some embodiments, the tear lines 213, 219 can be segments of a single tear line.

As shown, the lid blank 203 can have a generally rectangular configuration with beveled/angled/chamfered corners 221, 223, 225, 227. It will be understood that the blank 203 can have a different configuration or arrangement without departing from the disclosure. For example, the number and arrangement of lid panels of the blank 203 can be different to correspond to a different number or arrangement of tray portions of the tray blank 103.

With additional reference to FIG. 3, formation of the tray 105 from the blank 103 according to the first exemplary embodiment of the disclosure will be described. As shown, the blank 103 can be inverted, e.g., such that the exterior surface 101 is positioned on a supporting surface and such that an interior surface of the blank 103 is positioned facing upwardly.

The side panels 139, 143, 147, 151 of the first tray portion 121 the blank 103 can be folded at the respective fold lines 141, 145, 149, 153 at least partially upwardly relative to the respective bottom panel 137. Simultaneously or thereafter, the end flaps 155, 163 can be folded at the respective fold lines 159, 167 into at least partial face-to-face contact with respective portions of the side panel 139 and the side end flaps 157, 165 can be folded at the respective fold lines 161, 169 into at least partial face-to-face contact with respective portions of the side panel 147.

The top end flaps 179, 183, 187, 191 of the first tray portion 121 of the blank 103 can also be folded at the respective fold lines 181, 185, 189, 193 into a generally outward arrangement relative to the respective side panels 139, 143, 147, 151, e.g., such that the end flaps 179, 183, 187, 191 are in generally spaced and parallel arrangement with the bottom panel 137.

In the illustrated arrangement, the panels 137, 139, 143, 147, 151 extend at least partially around a first interior space or first tray compartment 109 of a first tray portion 107 of the tray 105, and the top end flaps 171, 183, 187, 191 are thus arranged extending generally outwardly from the respective panels 139, 143, 147, 151 to form a first rim or flange 195 of the tray 105.

Simultaneously or thereafter, the panels and end flaps of the tray portions 123, 127, 131 of the tray blank 103 can be folded in a manner similar to that described above with respect to the panels and end flaps of the first tray portion 121 of the tray blank 103 to form a respective second tray portion 111 of the tray 105 having a second tray compartment 113, a third tray portion 115 of the tray 105 having a third tray compartment 117, and a fourth tray portion 119 of the tray 105 having a fourth tray compartment 120.

It will be understood that the aforementioned erected configuration of the tray 105 can be at least partially maintained with one or more applications of an adhesive such as glue. In some embodiments, the tray 105 can be devoid of glue.

In this regard, the aforementioned formation of the tray 105 from the tray blank 103 provides tray portions 107, 111, 115, 119 that are separable from one another at respective flanges 195, e.g., at the respective tear lines 125, 129, 133, 135.

In such an open configuration of the tray 105 and tray portions thereof, one or more articles, e.g., food products F, can be positioned in a respective compartment 109, 113, 117, 120 of one or more of the tray portions 107, 111, 115, 119, as shown in FIG. 3. In some embodiments, the same or similar food products F can be at least partially received in a plurality of the tray portions 107, 111, 115, 119, e.g., to facilitate portioning of the food products F. In some embodiments, different food products can be placed in different tray portions 107, 111, 115, 119 to form a variety pack-type offering of different food products that are separated from one another.

Figure 4:
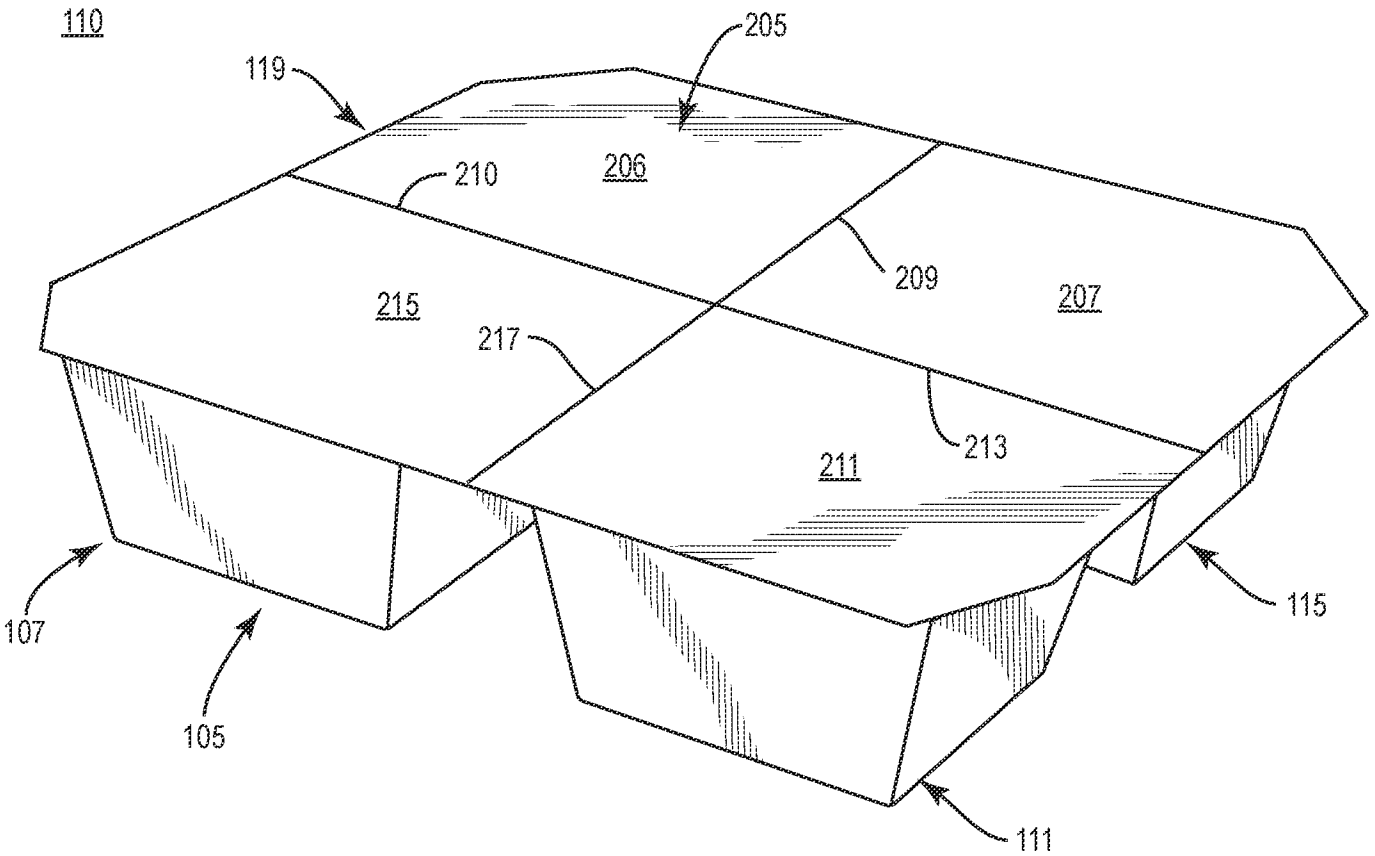
FIG. 4 is a perspective view of a system including the tray of FIG. 3 and a lid formed from the lid blank of FIG. 2 according to the first exemplary embodiment of the disclosure.

With additional reference to FIG. 4, the lid blank 203 can be positioned in at least partial face-to-face contact with respective portions of the respective flanges 195 of the tray portions 107, 111, 115, 119 to form the lid 205 for the tray 105 that is thus supported by the respective flanges 195 of the tray 105. In the illustrated arrangement, the tear lines 209, 213, 217, 219 can be positioned in general alignment with the tear lines 125, 129, 133, 135 of the tray 105 therebelow, though the lid 205 can be provided over the tray 105 in a different orientation without departing from the disclosure.

In the illustrated arrangement, the lid panels 206, 207, 211, 215 of the lid 205 can be positioned to at least partially enclose the food products F in the respective compartments 120, 117, 113, 109 of the respective tray portions 119, 115, 111, 107. In some embodiments, the lid 205 can be attached, for example, at least partially adhered, to respective portions of the respective flanges 195 of the tray portions 107, 111, 115, 119 to maintain a desired condition of the food products F, e.g., to maintain freshness, to avoid contact with debris from the environment, to prevent access by pests, etc.

In some embodiments, the lid 205 can be provided as part of the tray 105. In some embodiments, the lid 205 and tray 105 can be distinct components of a system 110 that includes at least the lid 205 and the tray 105.

Figure 5:
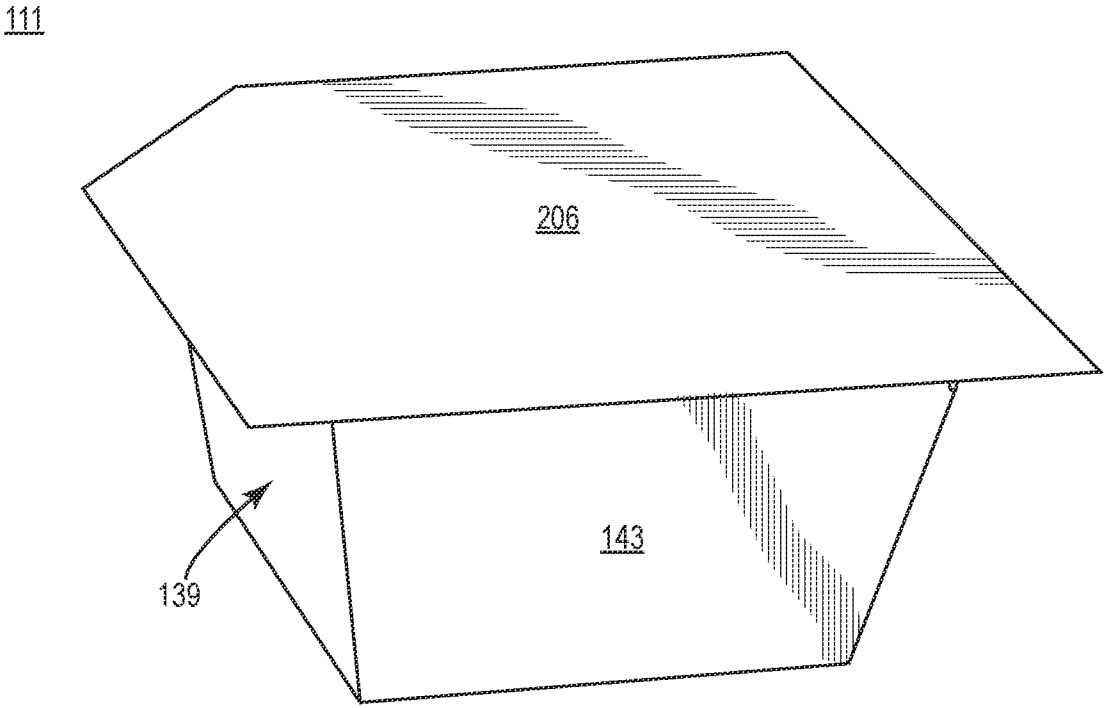
FIG. 5 is a perspective view of a tray portion and lid panel separated from the system of FIG. 4.
Figure 6:
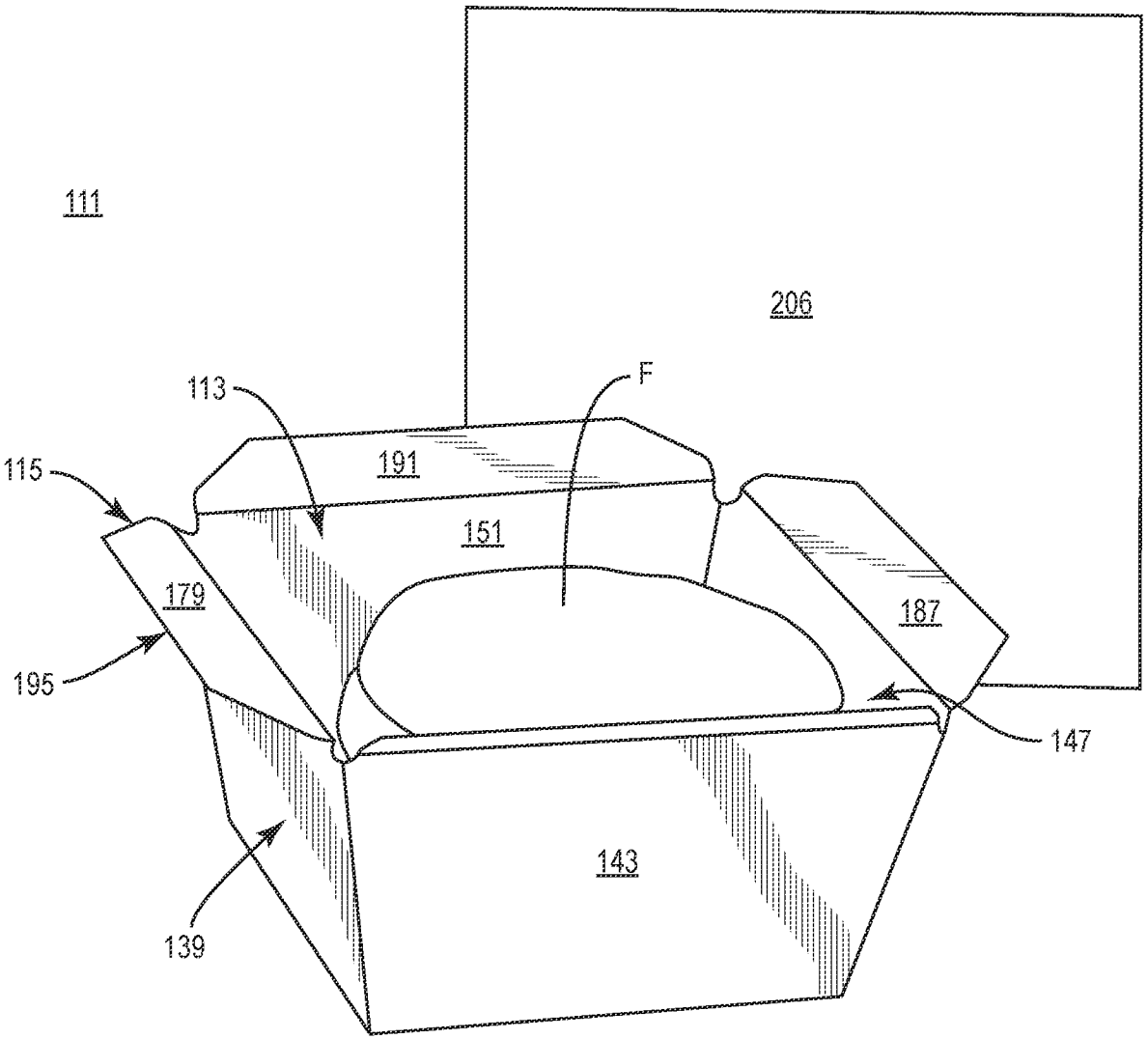
FIG. 6 is a perspective view of the tray portion of FIG. 5 with the lid panel removed.

Referring additionally to FIGS. 5 and 6, when it is desired to remove a selected tray portion 107, 111, 115, 119 from the remainder of the tray 105, for example, for a portioned serving, for serving of a particular article in the selected tray portion, for vending at a retail location, etc., the selected tray portion can be separated from the remainder of the tray 105 at the respective tear lines joining the selected tray portion to adjacent tray portions.

For example, the first tray portion 107 can be separated from the second tray portion 111 and the fourth tray portion 119 at the respective tear lines 125, 135, the second tray portion 111 can be separated from the first tray portion 107 and the third tray portion 115 at the respective tear lines 125, 129, the third tray portion 115 can be separated from the second tray portion 111 and the fourth tray portion 119 at the respective tear lines 129, 133, and the fourth tray portion 119 can be separated from the third tray portion 115 and the first tray portion 107 at the respective tear lines 133, 135.

The aforementioned separation of the selected tray portion from a remainder of the tray 105 can also cause a respective lid panel of the lid 205 attached thereto to separate from the remainder of the lid at respective tear lines. For example, the first lid panel 206 can be separated from the second lid panel 207 and the fourth lid panel 215 at the respective tear lines 209, 219, the second lid panel 207 can be separated from the first lid panel 206 and the third lid panel 211 at the respective tear lines 209, 213, the third lid panel 211 can be separated from the second lid panel 207 and the fourth lid panel 215 at the respective tear lines 213, 217, and the fourth lid panel 215 can be separated from the third lid panel 211 and the first lid panel 206 at the respective tear lines 217, 219.

In this regard, the tray 105 is separable into tray portions 107, 111, 115, 119, which can each be provided with a respective lid panel of the lid 205. Thus, a respective separated tray portion 107, 111, 115, 119 can be provided in an at least partially closed configuration via engagement of a respective lid panel 215, 211, 207, 206 with a respective flange 195, which can be selectively removed therefrom to provide access to a respective tray compartment 109, 113, 117, 120.

The combination of the tray 105 and lid 205 described herein can provide the tray 105 with separable tray portions that can maintain a closed top configuration upon separation, e.g., for distribution/serving to individual users, for portioning, for retail purposes, etc. In some embodiments, the blank 103 and the lid blank 203 can be formed from a composite material, e.g., paperboard, that is generally devoid of plastics, other polymeric materials, etc. In this regard, the tray 105 and lid 205 can be disposed of without contributing plastics or other polymeric materials to the waste stream. In some embodiments, the tray 105 and lid 205 can be comprised of materials so as to provide enhanced biodegradability.

It will be understood that blanks and trays according to the present disclosure can have a different number, arrangement, and/or configuration of features without departing from the disclosure.

Figure 7:
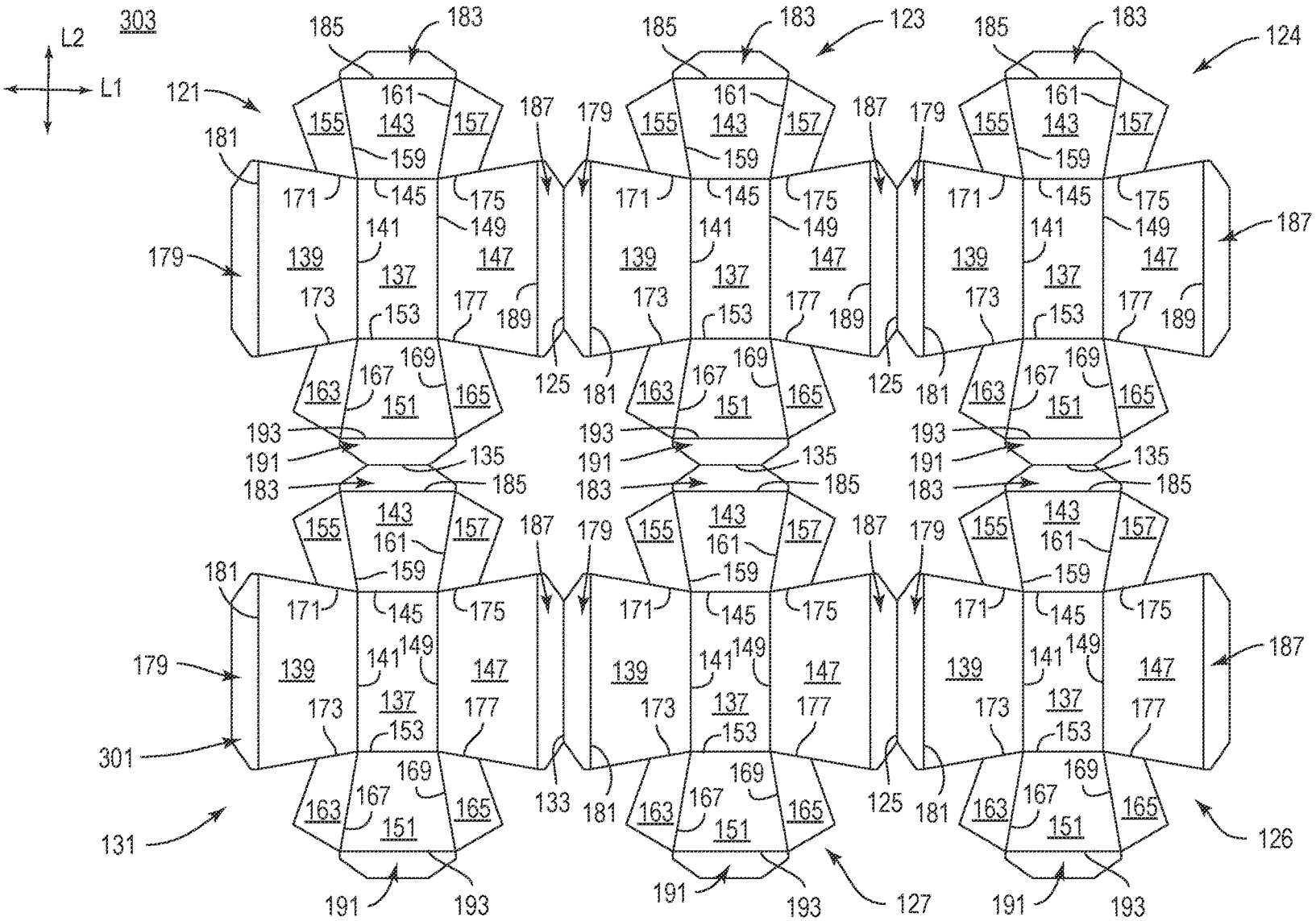
FIG. 7 is a plan view of an exterior surface of a tray blank for forming a tray according to a second exemplary embodiment of the disclosure.
Figure 8:
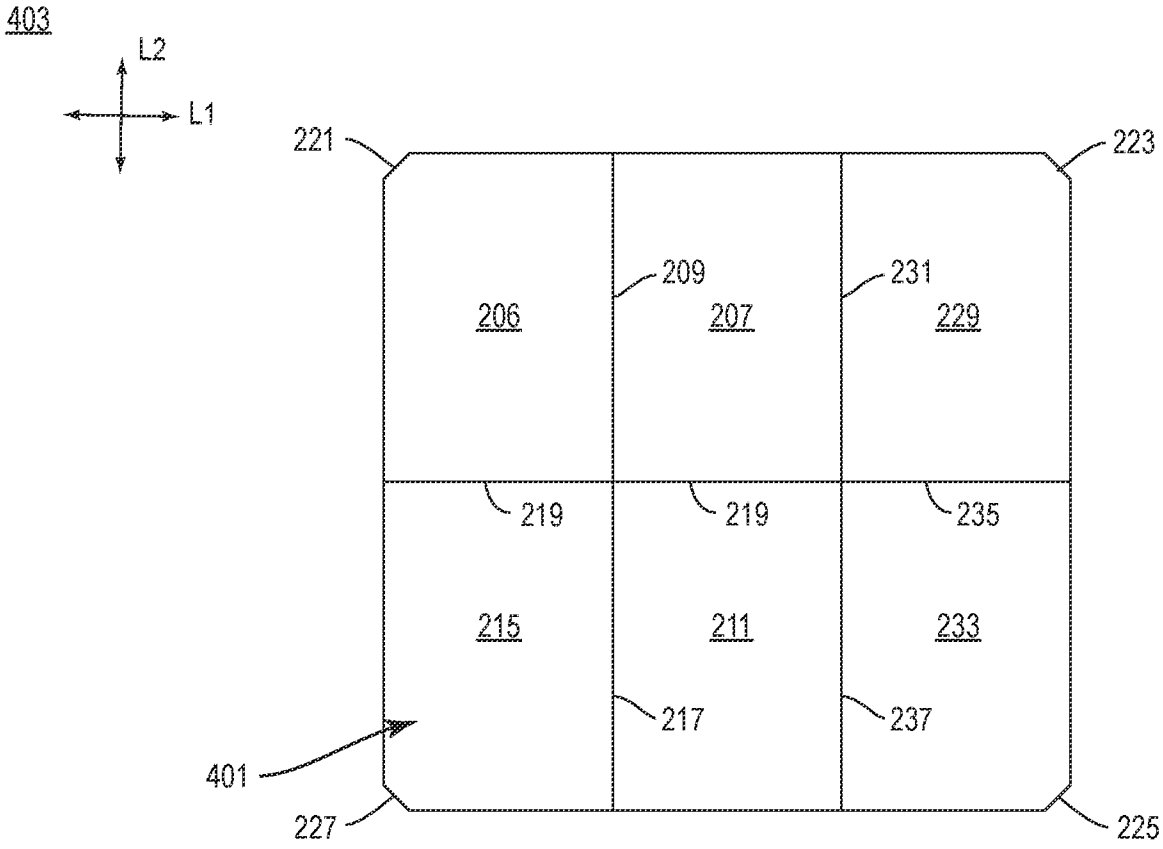
FIG. 8 is a plan view of an exterior surface of a lid blank for forming a lid according to the second exemplary embodiment of the disclosure.

For example, FIGS. 7 and 8 illustrate the respective exterior surfaces 301, 401 of a respective tray blank 303 and lid blank 403 according to a second exemplary embodiment of the disclosure having one or more features that are generally similar to those described above with respect to the tray blank 103 and lid blank 203, and like or similar features are designated with like or similar reference numerals.

As shown in FIG. 7, the tray blank 303 can include additional tray portions 121, 123, 127, 131 that are generally similar to those described above with respect to the blank 103 and tray 105 formed therefrom, except that the respective panels of the tray portions of the blank 303 are generally longer in the lateral direction L2 than in the longitudinal direction L1. The blank 303 can additionally include tray portions 124, 126 having the same general configuration as the tray portions 121, 123, 127, 131, with the tray portion 124 separably connected to the tray portion 123 at the respective lateral tear line 125, and with the tray portion 126 separably connected to the tray portion 124 at the respective longitudinal tear line 135 and separably connected to the tray portion 127 at the respective lateral tear line 125.

With reference to FIG. 8, the lid blank 403 can have a generally similar configuration to that described above with respect to the lid blank 203, except that the respective panels of the lid panels of the blank 403 are generally longer in the lateral direction L2 than in the longitudinal direction L1. The lid blank 403 can additionally include a lid panel 229 separably connected to the lid panel 207 at a lateral tear line 231 and a lid panel 233 separably connected to the lid panel 229 at a longitudinal tear line 235. The lid panel 233 can also be separably connected to the lid panel 211 at a lateral tear line 237. As shown, the lid panel 229 can define the corner 223 and the lid panel 233 can define the corner 225.

Figure 9:
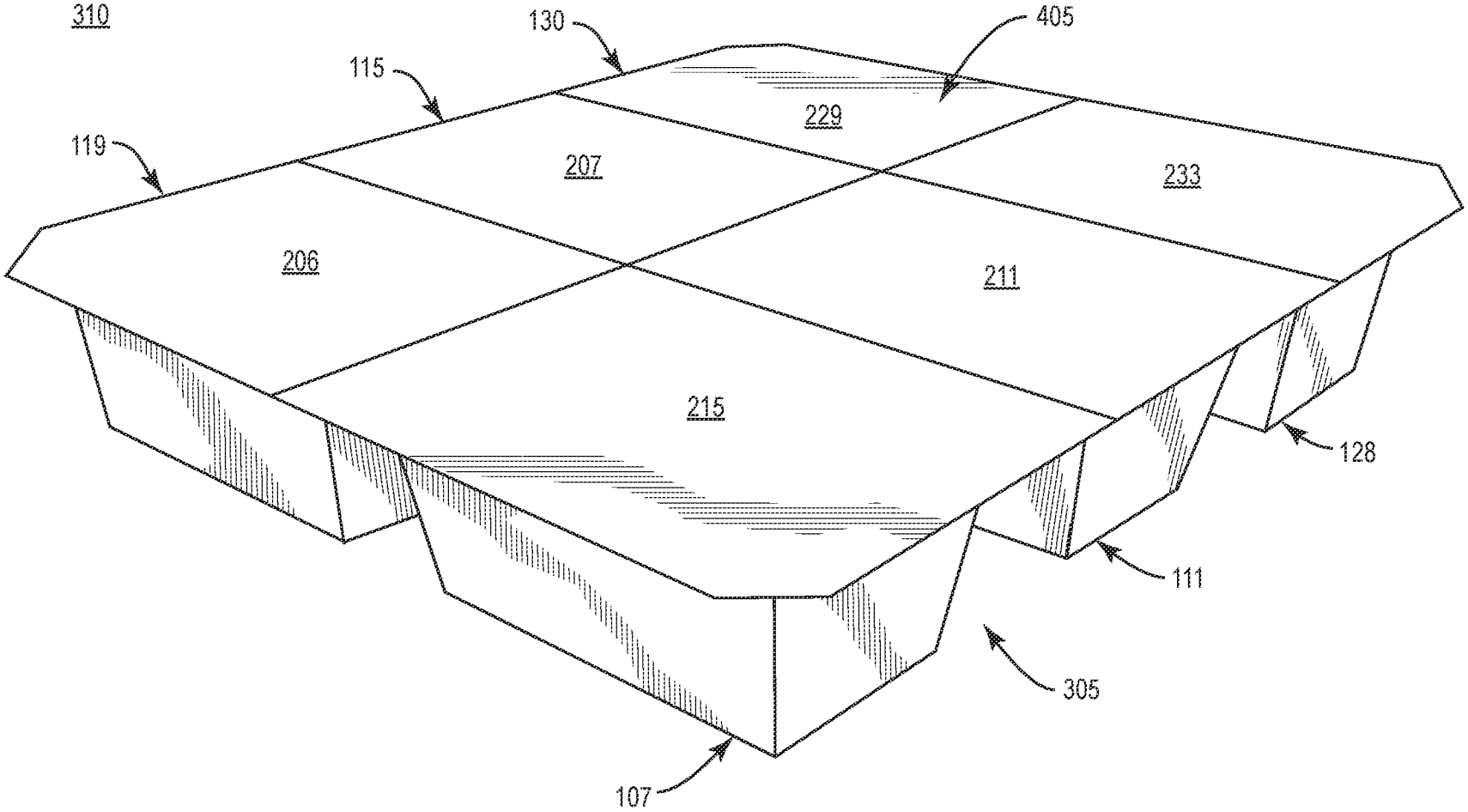
FIG. 9 is a perspective view of a system including a tray formed from the blank of FIG. 7 and a lid formed from the lid blank of FIG. 8 according to the first exemplary embodiment of the disclosure.
Figure 10:
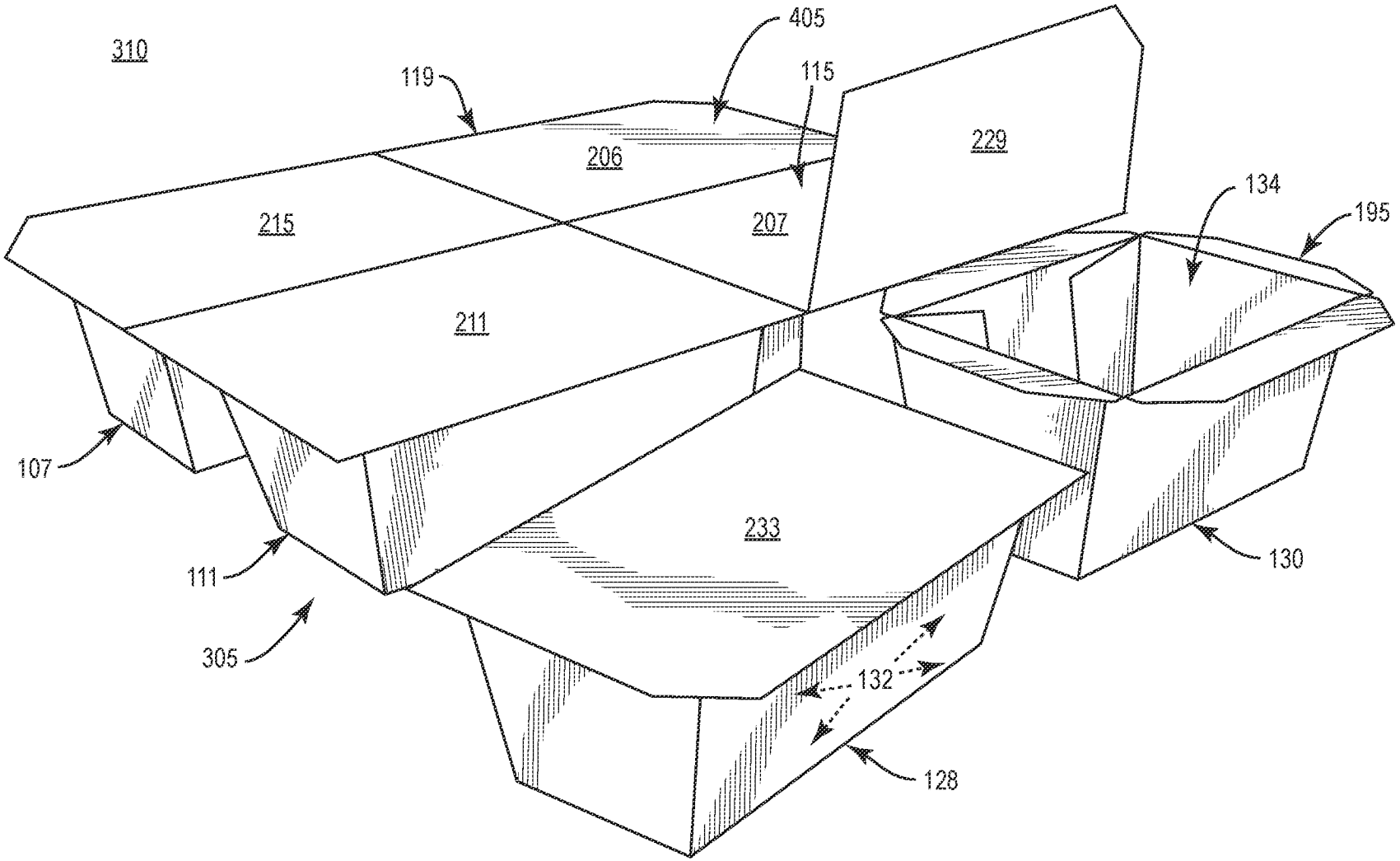
FIG. 10 is a perspective view of the system of FIG. 9 with a pair of tray portions and a lid portion separated therefrom.

With additional reference to FIGS. 9 and 10, a tray 305 can be formed from the blank 303 in a manner similar to that described above with regard to the formation of the tray 105 from the blank 103, with the tray portions 124, 126 additionally forming tray portions 128, 130 and respective tray compartments 132, 134.

Similarly, a lid 405 can be formed from the blank 403 in a manner similar to that described above with regard to the formation of the lid 205 from the blank 203, and positioned overlying the tray 305 such that the lid panels 229, 233 are positioned at least partially overlying the tray portions 130, 128.

As shown, the tray portions 128, 130 of the tray 305 can be at least partially separated from the tray portions 111, 115 at the respective tear lines 125, and from each other at the respective tear line 129. Such separation can include separation of the lid panels 233, 229 from the respective lid panels 211, 207 at the respective tear lines 237, 231 and/or from each other at the tear line 235. Further, the lid panels 233, 229 can be separated from the respective flanges 195 of the respective tray portions 128, 130 to expose the respective tray compartments 132, 134.

In this regard, a system 310 including the tray 305 and lid 405 can be formed from the blanks 303, 403 to provide advantages similar to those described above with regard to the system 110. In some embodiments, the tray 305 can be considered to include the lid 405.

In general, the blanks described herein may be constructed from paperboard having a caliper so that it is heavier and more rigid than ordinary paper. The blanks can also be constructed of other materials, such as cardboard, sheet plastics or any other material having properties suitable for enabling the container to function at least generally as described above. The blanks can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the container embodiments. The term "glue" is intended to encompass all manner of adhesives commonly used to secure container panels in place, and is not intended to exclude heat, chemical, or frequency bonding techniques.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A tray for holding one or more articles, the tray comprising:

a plurality of tray portions, each tray portion comprising:

a plurality of panels extending at least partially around a tray compartment of each tray portion; and a plurality of top end flaps arranged to form a flange separably connected along a tray tear line to a flange of an adjacent tray portion of the plurality of tray portions;

wherein the plurality of tray portions are components of a system that includes a lid comprising a plurality of lid panels, each lid panel separably connected along a respective lid tear line to an adjacent lid panel, wherein each lid panel is attached to a respective flange of a respective tray portion, and wherein each lid tear line is aligned with a respective tray tear line;

wherein in a first configuration, a first tray portion of the plurality of tray portions and a respective attached first lid panel of the plurality of lid panels are separable from an adjacent tray portion and adjacent lid panel while the first lid panel remains attached to the first tray portion, and wherein in a second configuration, the first lid panel is separated from the first tray portion while remaining attached to the adjacent lid panel and the first tray portion is subsequently separable from the adjacent tray portion.

2. The tray of claim 1, wherein the plurality of panels of each tray portion comprises a bottom panel and at least one side panel foldably connected to the bottom panel.

3. The tray of claim 2, wherein the plurality of top end flaps of each tray portion comprises a respective top end flap foldably connected to the respective at least one side panel.

4. The tray of claim 3, wherein the respective top end flap is separably connected to a respective flange of a respective adjacent tray portion of the plurality of tray portions.

5. The tray of claim 4, wherein the respective at least one side panel is a respective first side panel foldably connected to the respective bottom panel, and the plurality of panels of each tray portion comprises a second side panel, a third side panel, and a fourth side panel each foldably connected to the respective bottom panel.

6. The tray of claim 5, wherein the respective top end flap is a respective first top end flap foldably connected to the respective first side panel, and the plurality of top end flaps of each tray portion comprises a second top end flap foldably connected to the respective second side panel, a third top end flap foldably connected to the respective third side panel, and a fourth top end flap foldably connected to the respective fourth side panel, each respective first top end flap, second top end flap, third top end flap, and fourth top end flap forming a respective flange of the plurality of tray portions.

7. The tray of claim 6, wherein the respective first top end flap, second top end flap, third top end flap, and fourth top end flap extend outwardly from the respective plurality of panels of each respective tray portion.

8. The tray of claim 7, wherein the plurality of tray portions comprises a first tray portion forming a first tray compartment, a second tray portion forming a second tray compartment, a third tray portion forming a third tray compartment, and a fourth tray portion forming a fourth tray compartment.

9. The tray of claim 8, wherein the third top end flap of the first tray portion is separably connected to the first top end flap of the second tray portion, the fourth top end flap of the second tray portion is separably connected to the second top end flap of the third tray portion, the first top end flap of the third tray portion is separably connected to the third top end flap of the fourth tray portion, and the second top end flap of the fourth tray portion is separably connected to the fourth top end flap of the first tray portion.

10. A system, comprising:

a lid comprising a plurality of lid panels, each lid panel separably connected along a lid tear line to an adjacent lid panel; and a tray supporting the lid, the tray comprising:

a plurality of tray portions, each tray portion comprising:

a plurality of panels extending at least partially around a tray compartment of each tray portion; and a plurality of top end flaps arranged to form a flange separably connected along a tray tear line to a flange of an adjacent tray portion of the plurality of tray portions, wherein each lid tear line is aligned with a respective tray tear line;

wherein each lid panel is attached to a respective flange of a respective tray portion, wherein in a first configuration, a first tray portion of the plurality of tray portions and a respective attached first lid panel are separable from an adjacent tray portion and an adjacent lid panel while the first lid panel remains attached to the first tray portion, and wherein in a second configuration, the first lid panel is separated from the first tray portion while remaining attached to the adjacent lid panel and the first tray portion is subsequently separable from adjacent tray portions.

11. The system of claim 10, wherein the plurality of panels of each tray portion comprises a bottom panel and at least one side panel foldably connected to the bottom panel.

12. The system of claim 11, wherein the plurality of top end flaps of each tray portion comprises a respective top end flap foldably connected to the respective at least one side panel.

13. The system of claim 12, wherein the respective top end flap is separably connected to a respective flange of a respective adjacent tray portion of the plurality of tray portions.

14. The system of claim 13, wherein the respective at least one side panel is a respective first side panel foldably connected to the respective bottom panel, and the plurality of panels of each tray portion comprises a second side panel, a third side panel, and a fourth side panel each foldably connected to the respective bottom panel.

15. The system of claim 14, wherein the respective top end flap is a respective first top end flap foldably connected to the respective first side panel, and the plurality of top end flaps of each tray portion comprises a second top end flap foldably connected to the respective second side panel, a third top end flap foldably connected to the respective third side panel, and a fourth top end flap foldably connected to the respective fourth side panel, each respective first top end flap, second top end flap, third top end flap, and fourth top end flap forming a respective flange of the plurality of tray portions.

16. The system of claim 15, wherein the respective first top end flap, second top end flap, third top end flap, and fourth top end flap extend outwardly from the respective plurality of panels of each respective tray portion.

17. The system of claim 16, wherein the plurality of tray portions comprises a first tray portion forming a first tray compartment, a second tray portion forming a second tray compartment, a third tray portion forming a third tray compartment, and a fourth tray portion forming a fourth tray compartment.

18. The system of claim 17, wherein the third top end flap of the first tray portion is separably connected to the first top end flap of the second tray portion, the fourth top end flap of the second tray portion is separably connected to the second top end flap of the third tray portion, the first top end flap of the third tray portion is separably connected to the third top end flap of the fourth tray portion, and the second top end flap of the fourth tray portion is separably connected to the fourth top end flap of the first tray portion.

19. The system of claim 10, wherein each lid panel is supported on a respective flange of a respective tray portion.

20. The system of claim 19, wherein each lid panel at least partially overlies a respective tray compartment of the plurality of tray portions.

21. A combination of blanks for forming a system, the combination comprising:

a tray blank for forming a tray for holding one or more articles, the tray blank comprising:

a plurality of tray portions for forming a plurality of tray portions of the tray formed from the tray blank, each tray portion of the tray blank comprising:

a plurality of panels for extending at least partially around a respective tray compartment of each tray portion of the tray formed from the tray blank; and a plurality of end flaps foldably connected to a respective panel of the respective plurality of panels, the plurality of end flaps of each respective tray portion of the tray blank comprising a respective plurality of top end flaps for being arranged to form a-respective flange separably connected along a tray tear line to a-respective flange of an respective adjacent tray portion of the plurality of tray portions of the tray formed from the tray blank; and a lid blank for forming a lid for being at least partially supported by the tray formed from the tray blank, the lid blank comprising: a plurality of lid panels, each lid panel separably connected along a lid tear line to an adjacent lid panel, wherein at least one lid tear line is aligned with at least one tray tear line when the lid is formed and attached to the tray, wherein when the lid is formed and attached to the tray: each lid panel us attached to a respective flange of a respective tray portion and in a first configuration, a first tray portion of the plurality of tray portions and a respective attached first lid panel are separable from an adjacent tray portion and an adjacent lid panel while the first lid panel remains attached to the first tray portion, and in a second configuration, the first lid panel is separated from the first tray portion while remaining attached to an adjacent lid panel and the first tray portion is subsequently separable from adjacent tray portions.

22. The combination of claim 21, wherein the plurality of panels of each tray portion of the tray blank comprises a bottom panel and at least one side panel foldably connected to the bottom panel.

23. The combination of claim 22, wherein the plurality of top end flaps of each tray portion of the tray blank comprises a respective top end flap foldably connected to the respective at least one side panel.

24. The combination of claim 23, wherein the respective top end flap is separably connected to a respective top end flap of an adjacent tray portion of the plurality of tray portions of the tray blank.

25. The combination of claim 24, wherein the respective at least one side panel is a respective first side panel foldably connected to the respective bottom panel, and the plurality of panels of each tray portion of the tray blank comprises a second side panel, a third side panel, and a fourth side panel each foldably connected to the respective bottom panel.

26. The combination of claim 25, wherein the respective top end flap is a respective first top end flap foldably connected to the respective first side panel, and the plurality of top end flaps of each tray portion of the tray blank comprises a second top end flap foldably connected to the respective second side panel, a third top end flap foldably connected to the respective third side panel, and a fourth top end flap foldably connected to the respective fourth side panel.

27. The combination of claim 26, wherein the plurality of tray portions of the tray blank comprises a first tray portion for forming a first tray compartment of the tray formed from the tray blank, a second tray portion for forming a second tray compartment of the tray formed from the tray blank, a third tray portion forming a third tray compartment of the tray formed from the tray blank, and a fourth tray portion for forming a fourth tray compartment of the tray formed from the tray blank.

28. The combination of claim 27, wherein the third top end flap of the first tray portion of the tray blank is separably connected to the first top end flap of the second tray portion of the tray blank, the fourth top end flap of the second tray portion of the tray blank is separably connected to the second top end flap of the third tray portion of the tray blank, the first top end flap of the third tray portion of the tray blank is separably connected to the third top end flap of the fourth tray portion of the tray blank, and the second top end flap of the fourth tray portion of the tray blank is separably connected to the fourth top end flap of the first tray portion of the tray blank.

29. The combination of claim 21, wherein each lid panel is for being supported on a respective flange of a respective tray portion of the tray formed from the tray blank.

30. The combination of claim 29, wherein each lid panel is for being positioned at least partially overlying a respective tray compartment of the plurality of tray portions of the tray formed from the tray blank.

31. A method of forming a system that includes a tray for holding one or more articles, the method comprising:

obtaining a tray blank comprising a plurality of tray portions, each tray portion comprising a plurality of panels and a plurality of end flaps, each end flap foldably connected to a respective panel of the respective plurality of panels, the plurality of end flaps of each respective tray portion comprising a respective plurality of top end flaps;

positioning each plurality of panels extending around a respective tray compartment of a respective plurality of tray portions of the tray;

arranging the plurality of end flaps of each respective tray portion of the tray blank to form a flange separably connected along a tray tear line to a flange of an adjacent tray portion of the plurality of tray portions of the tray;

obtaining a lid blank comprising a plurality of lid panels, each lid panel separably connected to an adjacent lid panel along a lid tear line; and attaching each lid panel to a respective flange of a respective tray portion such that at least one lid tear line is aligned with at least one tray tear line and such that in a first configuration, a first tray portion and an attached first lid panel are separable from adjacent tray portions and adjacent lid panels as an assembly, and such that in a second configuration, the first lid panel is separated from the first lid portion while remaining attached to an adjacent lid panel and the first tray portion is separable from adjacent tray portions.

32. The method of claim 31, wherein the plurality of panels of each tray portion of the blank comprises a bottom panel and at least one side panel foldably connected to the bottom panel.

33. The method of claim 32, wherein the plurality of top end flaps of each tray portion of the blank comprises a respective top end flap foldably connected to the respective at least one side panel.

34. The method of claim 33, wherein arranging the plurality of end flaps comprises arranging the respective top end flap being separably connected to a respective top end flap of an adjacent tray portion of the plurality of tray portions of the tray.

35. The method of claim 34, wherein the respective at least one side panel is a respective first side panel foldably connected to the respective bottom panel, and the plurality of panels of each tray portion of the tray blank comprises a second side panel, a third side panel, and a fourth side panel each foldably connected to the respective bottom panel.

36. The method of claim 35, wherein the respective top end flap is a respective first top end flap foldably connected to the respective first side panel, and the plurality of top end flaps of each tray portion of the blank comprises a second top end flap foldably connected to the respective second side panel, a third top end flap foldably connected to the respective third side panel, and a fourth top end flap foldably connected to the respective fourth side panel.

37. The method of claim 36, wherein the plurality of tray portions of the blank comprises a first tray portion, a second tray portion, a third tray portion, and a fourth tray portion, and positioning each plurality of panels comprises positioning each plurality of panels to for a first tray compartment, a second tray compartment, a third tray compartment, and a fourth tray compartment.

38. The method of claim 37, wherein the third top end flap of the first tray portion of the blank is separably connected to the first top end flap of the second tray portion of the blank, the fourth top end flap of the second tray portion of the blank of the blank is separably connected to the second top end flap of the third tray portion of the blank, the first top end flap of the third tray portion of the blank is separably connected to the third top end flap of the fourth tray portion of the blank, and the second top end flap of the fourth tray portion of the blank is separably connected to the fourth top end flap of the first tray portion of the blank.

39. The method of claim 31, wherein attaching each lid panel comprises positioning each lid panel at least partially overlying a respective tray compartment of the plurality of tray portions of the tray.

* * * * *